United States Patent [19]

Hansen

[11] 4,276,843

[45] Jul. 7, 1981

[54] DOME TOOLING TO ELIMINATE TAB PROTRUSION OF A CAN END

[75] Inventor: Everett T. Hansen, Chicago, Ill.

[73] Assignee: The Continental Group, Inc., New York, N.Y.

[21] Appl. No.: 44,816

[22] Filed: Jun. 1, 1979

[51] Int. Cl.[3] ..... B21D 51/38

[52] U.S. Cl. ..... 113/1 F; 72/322; 113/121 C

[58] Field of Search ..... 220/266, 268, 269, 270, 220/276, 259; 113/121 R, 1 F, 121 C, 121 A; 72/350, 351, 322

[56] References Cited

U.S. PATENT DOCUMENTS

| | | | |
|---|---|---|---|
| 2,681,630 | 6/1954 | Hempel | 72/350 |
| 3,457,761 | 7/1969 | Brosseit | 72/350 X |
| 3,855,862 | 12/1974 | Moller | 72/349 |
| 4,027,612 | 6/1977 | Herbst | 113/121 C |

*Primary Examiner*—Mark Rosenbaum

*Attorney, Agent, or Firm*—Charles E. Brown

[57] ABSTRACT

A tooling for stretching and doming the end panel of an easy opening end unit wherein the end panel is axially displaced at the center thereof so as to stretch the metal of the end panel and the end panel is bent around a small radius annular corner of a support to effect a rigid and permanent displacement of the end panel in the form of a dome.

7 Claims, 2 Drawing Figures

DOME TOOLING TO ELIMINATE TAB PROTRUSION OF A CAN END

This invention relates in general to new and useful improvements in easy opening end units, and more particularly to tooling for effecting the doming of an end panel of an end unit of the easy opening type for the purpose of stretching the loose metal of the end unit and thereby eliminate tab protrusion.

In the formation of an end unit of the easy opening type, in order to define a removable panel portion the end unit is provided with a line of weakening which is preferably in the form of a score. The formation of that score, as well as the formation of the rivet which is normally utilized to secure a pull tab to the end panel, normally results in a loosening of the metal of the end panel. The net result is that, particularly with larger diameter end units, when the container of which the end unit is a part is internally pressurized, the end panel is bowed axially outwardly and the grip portion of the pull tab in particular is deflected axially beyond the confines of the end unit.

A particular feature of the invention is the manner in which the doming is effected and the tooling for effecting same. The end panel is supported on an annular support which has an inner periphery of a lesser diameter than the line of weakening, and while clamped on that support a central part of the end panel is axially displaced utilizing a punch in such a manner that the metal of the end panel is bent at the inner periphery of the support.

Most particularly the controlled bending of the metal of the end panel and thus the controlled doming of the end panel is effected by engaging a central part only of the end panel in radially spaced relation with respect to the support and then axially displacing the punch so engaging the central part only of the end panel so as to effect bending of the end panel primarily around the inner corner of the annular support.

In order to effect such a bending or doming operation, the punch preferably has a central end panel engageable surface surrounded by a clearance, which clearance is defined by a frustoconical surface.

It is also preferred that the tool be such that the inner corner of the support have a small diameter radius, for example a radius on the order of 0.030 inch so that when the central part of the end panel is axially displaced bending of the metal of the end unit is effected around that radiused inner annular corner of the support.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
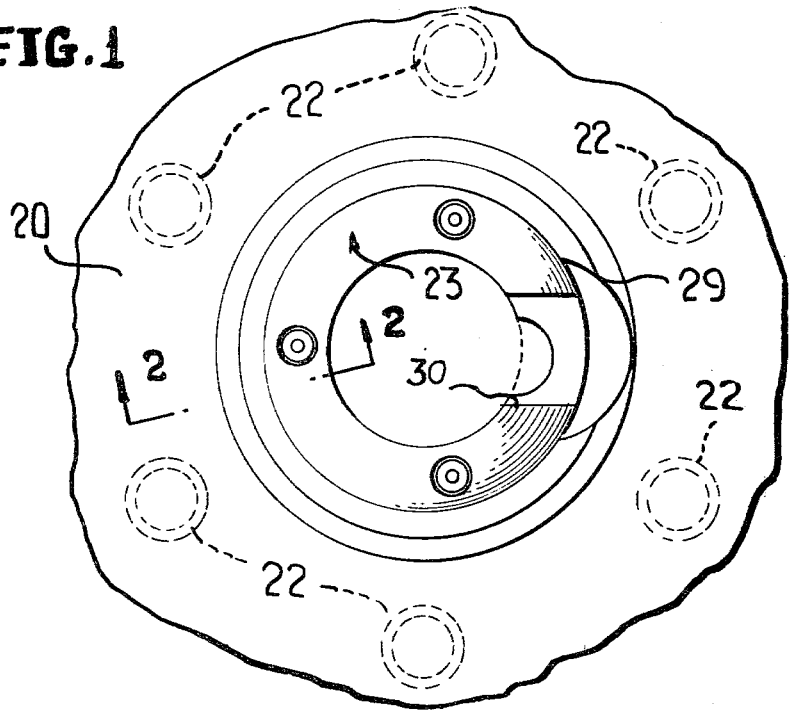
FIG. 1 is a bottom plan view of a clamping pad and doming punch formed in accordance with this invention, the outer portion of the clamping pad being broken away.

Referring now to the drawings in detail, it will be seen that there is illustrated a conventional end unit generally identified by the numeral 5 which is being domed in accordance with this inventon. The end unit 5 includes the customary chuck wall 6 which surrounds an end panel 7. The end panel 7 is provided with a peripheral line of weakness in the form of a score 8 so as to define a removable panel portion 10.

In the illustrated embodiment of the invention, the end panel 7 is provided with a pair of annular reverse folds 11, 12 which in and of themselves do not form a part of this invention.

It is to be understood that the end panel 7 will have formed in the removable panel portion 10 an integral rivet of a conventional type which secures to the end panel a pull tab (not shown) of a conventional type for facilitating the rupture of the end panel 7 along the line of weakness 8 and the removal thereof together with the pull tab. In the formation of the rivet and the score 8, there is a displacement of metal of the end panel 7 which results in a loosening of the metal of the end panel. When the metal of the end panel is loose, the resistance of the end panel against bowing or doming under internal pressures is greatly reduced, an thus there is a tendency for the end panel to become domed under pressure. The doming of the end panel per se is not critical. However, when the end panel domes, particularly the removable panel portion having formed therein the integral rivet, the pull tab becomes tilted as opposed to lying in a plane generally normal to the axis of the end unit, and thus the radially inner end portion or grip portion thereof is shifted axially so as to project above the chuck wall 6. This is highly undesirable, particularly from the standpoint of packaging the stacking. Further, in the event doming occurs prior to the application of the end unit to a can body, the tilted position of the pull tab frequently obstructs the double seaming of the end unit to the can body.

In accordance with this invention, it is proposed axially to dome the major part of the end panel in a direction toward the interior of the resulting can so as to stretch the metal of the end unit and thereby eliminate the looseness of the metal and the general freedom of the metal to dome undesireably under internal pressures.

It has been found that the required stretching of the metal of the end unit and the resultant doming can be best effected if a central part only of the end panel is engaged by a doming punch and that bending of the end panel occurs about a radially inner corner of an associated support.

Most particularly, it is proposed to form the support with a radially inner corner which is of a relatively small radius.

To this end there is provided tooling, generally identified by the numeral 14. The tooling 14 includes a support 15 having a projecting annular support part 16 with a flat end surface 17 and an annular inner corner 18 of a small radius, for example a radius on the order of 0.030 inch. The end unit 5 is seated on the support 15 in centered relation. The diameter of the surface 17 is such that the line of weakness 8 is disposed radially outwardly of the annular corner 18, as is clearly shown in FIG. 2.

The tooling 14 also includes a clamping pad 20 which includes a projecting annular part 21 which generally opposes and is in alignment with the annular part 16 of the support. The clamping pad 20, during the operation of an associated press, is resiliently urged into clamping engagement with the upper surface of the end panel 7 by a plurality of springs which are diagrammetically illustrated in FIG. 2 and best shown in FIG. 1. The springs, identified by the numeral 22, are preferably six in number and are circumferentially spaced about the clamping pad.

It is to be noted that the inner diameter of the projecting part 21 of the clamping pad 20 is of a lesser diameter than the innner diameter of the projecting annular part 16 of the support 15. This permits the clamping of the end panel 7 in an annular pattern disposed entirely radially outwardly of the inner boundary of the clamping pad 20.

A doming punch, generally identified by the numeral 23, is associated with the clamping pad 20, the doming punch 23 being circular in outline and being telescoped within the clamping pad 2. It is to be understood that the doming punch 23 and the clamping pad 20 are mounted on a common supporting pad (not shown) of a punch mechanism for movement together, but wherein, once the clamping pad 20 has engaged the end panel 7 seated on the support 15, further movement of the clamping pad 20 will cease and the doming punch will continue to move axially during the operation of the press.

The doming punch 23 has an operative end which is configurated to define a central circular outline end panel engaging surface 24 which is generally surrounded by a clearance 25. The clearance 25 is preferably defined by a fustoconical surface 26 surrounding the central surface 24.

Figure 2:
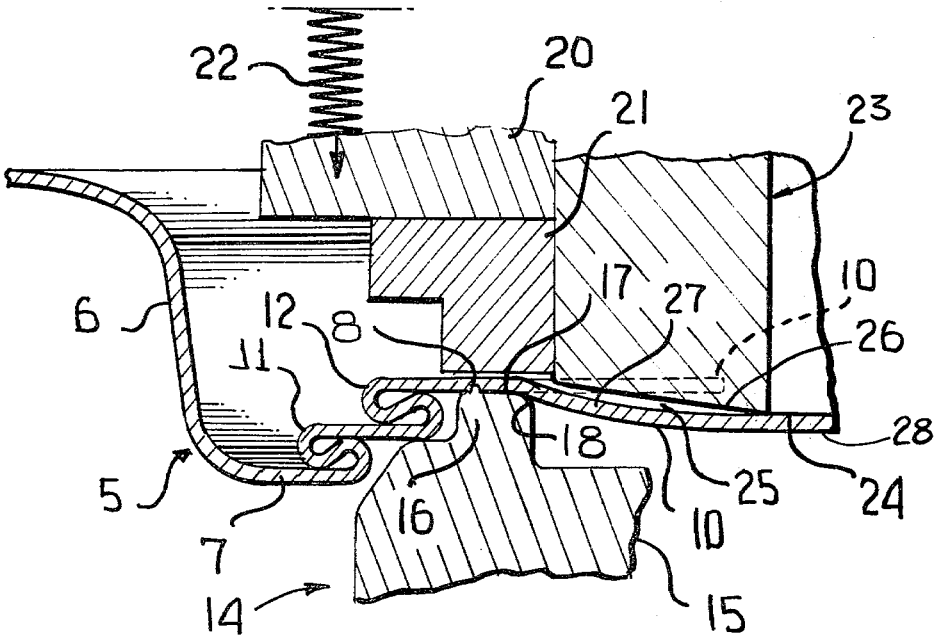
FIG. 2 is an enlarged fragmentary sectional view taken generally along the line 2—2 of FIG. 1, and shows the clamping pad and doming punch associated with an end unit positioned on an annular support for clamping the end unit in place on the support by the clamping pad and the displacement of the central portion of the end panel by the cooperation of the doming punch and the support.

As will be apparent from FIG. 2, since the doming punch 23 engages only a central part of the end panel 7, as the doming punch moves the central part of the end panel axially, the central part of the end panel is displaced. The displacement is such that an annular part 27 of the end panel is unsupported. The net result is that the central part of the end panel, the central part being defined by the numeral 28, is displaced and the end panel must bend with the bending occurring about the small radius corner 18 of the projecting part 16 of the support 15. The clearance 25 permits this required bending and the bending and doming of the end panel is such so as to stretch the metal of the end panel and thus remove all looseness from the end panel. Because of the very small radius of the corner 18, there will be a definite set in the metal of the end panel which will permit the end panel to remain domed ater the pressure exerted on the end panel by the doming punch is removed.

It will be readily apparent that by so doming the end panel in a direction opposite from that which would normally occur due to internal pressures within an associated can, not only is the loose metal removed from the end panel, but also the end panel 7 is so stiffened as to resist outward bowing or deformation due to internal pressures. Thus, the pull tab (not shown) secured to the end panel remains substantially parallel to the original plane of the end panel and does not project unduly away from that end panel.

It is to be noted from FIG. 1 that the doming punch 23 is provided with a radial slot 30 which is aligned with a through bore 29 formed in the projecting part 21 of the clamping pad 20. By properly indexing the end unit to be domed, the pull tab thereof will be received in these aligned openings or clearances and will not be contacted by either the clamping pad 20 or the doming punch 23.

It is to be understood that the displacement of the central part of the end panel may be controlled so as to provide for the desired stretching of the metal of the end panel required to remove slack from the end panel and thus prevent improper doming of the end panel due to internal pressures.

Although only a single preferred embodiment of the inventon has been specifically illustrated and described herein, it is to be understood that minor variations may be made in the tooling without departing from the spirit and scope of the invention as defined by the appended claims.

I claim:

1. A method of doming an end panel of a metal easy opening end unit having a removable panel portion defined by a peripheral line of weakness to remove inherently loose metal from the end panel, said method comprising the steps of clamping an outer portion of an end panel including said peripheral line of weakness on an annular support, and while holding said end panel including said peripheral line of weakness on the annular support, engaging a central part only of said end panel and axially displacing said end panel within said support to stretch the metal of said end panel to remove said loose metal from said end panel and to effect a minor doming of said end panel radially inwardly of said peripheral line of weakness.

2. The method of claim 1 wherein said support is provided with a rounded inner annular corner, and bending of said end panel is effected over said corner.

3. Press tooling comprising a hollow support for receiving in seated engagement an end panel of an end unit having formed therein a score line defining a removable panel portion and having attached thereto a pull tab, said hollow support being a preselected size and having a preselected internal configuration, a clamp for cooperating with said support to retain an end unit in position on said support, and a punch for axially inwardly doming an end panel within said support, said punch having an end for engaging an end panel, said clamp having an inner configuration and said punch having a cross section smaller than the internal configuration of said support, thereby defining a predetermined bend zone for an end panel surrounding said punch, and said punch having a groove in said end for clearing a pull tab.

4. The press tooling of claim 3 wherein said support has a supporting surface in part defined by a rounded inner corner, said rounded inner corner forming bend defining means for controlling the bending of an end panel.

5. Press tooling comprising a hollow support for receiving in seated engagement an end panel of an end unit having formed therein a score line defining a removable panel portion, said hollow support being of a preselected size and having a preselected internal configuration, a clamp for cooperating with said support to retain an end unit in position on said support, and a punch for axially inwardly doming an end panel within said support, said clamp having an inner configuration and said punch having a cross section smaller than the internal configuration of said support, thereby defining a predetermined bend zone for an end panel surrounding said punch, said punch having an end generally facing said support, and said punch end including a central end panel engaging surface and a surrounding clearance portion wherein an end panel being domed is free of engagement between said support and said central end panel engaging surface.

6. The press tooling of claim 5 wherein said support has a supporting surface in part defined by a rounded inner corner, said rounded inner corner forming bend defining means for controlling the bending of an end panel.

7. The press tooling of claim 5 wherein said clearance portion is defined by a generally frustoconical surface.

* * * * *